US009149728B2

(12) United States Patent
Beyr

(10) Patent No.: US 9,149,728 B2
(45) Date of Patent: Oct. 6, 2015

(54) ENTERTAINMENT RIDE

(71) Applicant: Markus Beyr, Schleissheim (AT)

(72) Inventor: Markus Beyr, Schleissheim (AT)

(73) Assignee: Attraktion! GmbH, Vienna (AT)

( * ) Notice: Subject to any disclaimer, the term of this patent is extended or adjusted under 35 U.S.C. 154(b) by 0 days.

(21) Appl. No.: 14/015,475

(22) Filed: Aug. 30, 2013

(65) Prior Publication Data

US 2015/0065260 A1 Mar. 5, 2015

(51) Int. Cl.

| | |
|---|---|
| ***A63G 1/10*** | (2006.01) |
| ***A63G 31/16*** | (2006.01) |
| ***A63J 25/00*** | (2009.01) |
| *A63G 1/38* | (2006.01) |
| *A63J 5/00* | (2006.01) |

(52) U.S. Cl.

CPC ..... *A63G 31/16* (2013.01); *A63J 25/00* (2013.01); *A63G 1/10* (2013.01); *A63G 1/38* (2013.01); *A63J 2005/002* (2013.01)

(58) Field of Classification Search

CPC ..... A63G 1/00; A63G 1/10; A63G 19/00; A63G 19/20; A63G 31/00; A63G 31/16; A63H 33/00; A63H 33/22

USPC ..... 472/58–64, 75–80, 130, 136, 131; 52/6–10

See application file for complete search history.

(56) References Cited

U.S. PATENT DOCUMENTS

| | | | | |
|---|---|---|---|---|
| 3,758,714 | A * | 9/1973 | Herndon | 348/38 |
| 6,280,341 | B1 * | 8/2001 | Hayashi | 472/61 |
| 8,206,230 | B2 * | 6/2012 | Magpuri | 472/60 |
| 2010/0300006 | A1 | 12/2010 | Magpuri | |

FOREIGN PATENT DOCUMENTS

| | | | |
|---|---|---|---|
| DE | 3224953 | A1 | 1/1984 |
| DE | 202012012264 | U1 | 4/2013 |
| EP | 1005887 | A2 | 6/2000 |
| JP | H04187173 | A | 7/1992 |
| KR | 20130080618 | A | 7/2013 |

OTHER PUBLICATIONS

International Search Report dated Dec. 18, 2014, including the Written Opinion of the International Searching Authority, in International Application No. PCT/IB2014/001628.

* cited by examiner

*Primary Examiner* — Kien Nguyen

(74) *Attorney, Agent, or Firm* — Maier & Maier, PLLC

(57) ABSTRACT

In order to provide an amusement ride having an enhanced experience factor, the amusement ride comprises a motion base, an audience platform mounted to the motion base, a plurality of seats, each accommodating at least one guest, supported on the audience platform, wherein the seats are arranged in at least one circular row, a 360° projection screen surrounding the audience platform, wherein the projection screen comprises a dome portion and a lower extension portion directly adjoining the dome portion, a plurality of projectors being arranged to project images on the entire projection screen.

16 Claims, 8 Drawing Sheets

ENTERTAINMENT RIDE

FIELD

The invention refers to amusement rides, such as amusement rides for amusement parks.

BACKGROUND

Theme or amusement park ride attractions have become increasingly popular. Amusement rides can generally be characterized into rides that include ride vehicles that travel along a track and rides that are fixed relative to the ground. In fixed rides, an audience platform or ride vehicle is typically situated on a motion base having multiple degrees of freedom. An amusement ride of this kind is described in U.S. Pat. No. 8,206,230 B2. These types of motion bases are also frequently positioned adjacent to one or more projection screens. A series of images or a motion picture is then projected onto the screen. For added realism and effect, the movement of the motion base can be synchronized with the projected images.

The motion base can move the audience platform in several different directions including angular movements, such as roll, pitch and yam, and linear movements, such as heave and surge. The various degrees of freedom can be used to simulate the effect of actually moving in synchronization with the projected images or motion picture.

While prior art amusement rides have focused on improving the synchronization of the motion base movement with the projected motion picture, those rides often use projection screens that are limited in size. Consequently, prior art amusement rides have the drawback that the projections do not extend over the entire field of view of the individual user resulting in that the audience is not totally immersed into the ride experience.

Accordingly, there is a need for an improved amusement ride having an enhanced experience factor. In particular, it is an object of the instant invention to provide an amusement ride offering an improved ride experience and increasing the audience's immersion into a virtual environment.

SUMMARY

In a first aspect of the invention, an amusement ride comprises a motion base, an audience platform mounted to the motion base, a plurality of seats, each accommodating at least one guest, supported on the audience platform, wherein the seats are arranged in at least one circular row, a 360° projection screen surrounding the audience platform, wherein the projection screen comprises a dome portion and a lower extension portion directly adjoining the dome portion, and a plurality of projectors being arranged to project images on the entire projection screen. Thus, the invention provides for an increase field of projection. Each of the portions of the projection screen surrounds the audience platform so that the screen extends over an angle of 360° when seen in a horizontal plane. Preferably, the dome portion and the extension portion of the projections screen are arranged and realized such that they together provide a projection surface extending over an angle of more than 180° measured in a vertical plane from a center of the dome. In this way, the projection screen extends not only above the audience's head, but also below their feet. In particular, the dome portion of the projection screen comprises a closed top so that the dome portion completely encases the audience platform also from above.

According to a preferred embodiment of the invention, the dome portion of the projection screen is formed substantially in a shape of a hemispherical dome. Alternatively, the dome portion can have any other curved shape that surrounds the audience platform by 360° and that completely covers the audience platform from above.

Preferably, the dome portion and the extension portion of the projection screen are immediately adjacent to each other, so that a continuous screen surface is achieved that does not have any gap between the dome portion and the extension portion. In particular, the dome portion and the extension portion of the projection screen merge in the same tangential plane, so that there is no substantial kink in the transition between both portions.

According to a first preferred embodiment of the invention, the extension portion of the projection screen is formed substantially in a shape of a cylinder.

In a second preferred embodiment of the invention the extension portion of the projection screen is in the form of a spherical extension of the dome portion. In particular, the spherical extension extends the dome portion beyond its hemispherical dome shape so that the projection screen is extended from a 180° segment of a sphere to a segment of a sphere having an angle greater than 180°, in particular at least 210°, preferably at least 230°.

In a further aspect of the invention an amusement ride comprises a motion base, an audience platform mounted to the motion base, a plurality of seats, each accommodating at least one guest, supported on the audience platform, wherein the seats are arranged in at least one circular row, a 360° projection screen surrounding the audience platform and comprising a dome portion, and a plurality of projectors being arranged to project images on the entire projection screen, wherein the audience platform is in the form of a ring surrounding a vertical shaft and is arranged to be rotated about a vertical axis of the shaft. In this way, the audience's position within and under the dome can be changed easily and various rides can be performed.

Preferably, the seats in the circular row are arranged such that the guests, when seated, are oriented radially outwardly so that the viewing direction is directly towards the projection screen.

Alternatively or additionally, the motion base supporting the ring-shaped audience platform is preferably guided on the vertical shaft so as to be displaceable in the height direction.

In order to enable the audience to easily and quickly access and/or leave the audience platform, a preferred embodiment provides for at least one stationary loading and unloading platform that is arranged within the cylindrical extension portion of the projection screen, said loading and unloading platform having a central opening with a diameter substantially corresponding to an outer diameter of the ring-shaped audience platform. Preferably, two or more audience platforms and two or more corresponding loading and unloading platforms can be arranged. The loading and unloading platforms are preferably arranged in parallel to each other and at different levels within or under the dome, in particular within the cylindrical extension portion of the projection screen. Thereby, each loading and unloading platform is assigned to a respective audience platform.

According to a preferred embodiment, the loading and unloading platform has a circular outer circumference, wherein the loading and unloading platform has an outer diameter substantially corresponding to an inner diameter of the cylindrical extension portion of the projection screen. In this way, the loading and unloading platform forms a bottom surface of the cylindrical extension portion of the projection screen. Alternatively, the loading and unloading platform forms an intermediate bottom between an upper and a lower section of a projection area. Accordingly, the audience platform can be moved in the height direction in order to be alternatively positioned in the upper or in the lower projection area.

In a further aspect of the invention an amusement ride comprises a motion base, an audience platform mounted to the motion base, a plurality of seats, each accommodating at least one guest, supported on the audience platform, wherein the seats are arranged in at least one circular row, a 360° projection screen surrounding the audience platform and comprising a dome portion, and a plurality of projectors being arranged to project images on the entire projection screen, wherein the audience platform has a circular outer circumference, the curvature of which substantially corresponds to the curvature of the spherical dome portion and the spherical extension portion of the projection screen.

Preferably, the seats in the circular row are arranged such that the guests, when seated, are oriented radially inwardly, so that the viewing direction is directly towards the opposite surface of the projection screen.

According to a preferred embodiment, the motion base is formed substantially in a shape of a ring, said ring being supported so as to tilt about a tilting axis extending along a diameter of the dome portion of the projection screen and to rotate about a rotating axis extending transverse to the tilting axis. The ring-shaped configuration of the motion base allows to keep the central part of the area below the dome free from any support structure, so that the audience's view is not disturbed in any way.

Particularly preferred, the audience platform is also in the form of a ring.

In order to enable the audience to easily and quickly access and/or leave the audience platform, a preferred embodiment provides for at least one circular loading and unloading platform arranged within the projection screen, an outer diameter of said loading and unloading platform substantially corresponding to an inner diameter of the ring-shaped audience platform.

According to a preferred embodiment, an outer diameter of said circular loading and unloading platform substantially corresponds to an inner diameter of a lower opening of the spherical extension portion. In this way the loading and unloading platform, if arranged to be raised to a level of the audience platform and lowered to a parking position, forms a bottom of the projection screen in its lowered parking position. In this position, the loading and unloading platform may serve as an additional projection screen surface, so that a 360° projection can be realized not only in a horizontal plane, but also in a vertical plane.

BRIEF DESCRIPTION OF THE DRAWINGS

The invention will now be further explained with reference to the drawings.

DETAILED DESCRIPTION

Aspects of the present invention are disclosed in the following description and related figures directed to specific embodiments of the invention. Those skilled n the art will recognize that alternate embodiments may be devised without departing form the spirit or the scope of the claims. Additionally, well-known elements of exemplary embodiments of the invention will not be described in detail or will be omitted so as not to obscure the relevant details of the invention.

It should be understood that the described embodiments are not necessarily to be construed as preferred or advantageous over other embodiments. Moreover, the germs "embodiments of the invention", "embodiments" or "invention" do not require that all embodiments of the invention include the discussed feature, advantage or mode of operation.

Figure 1:
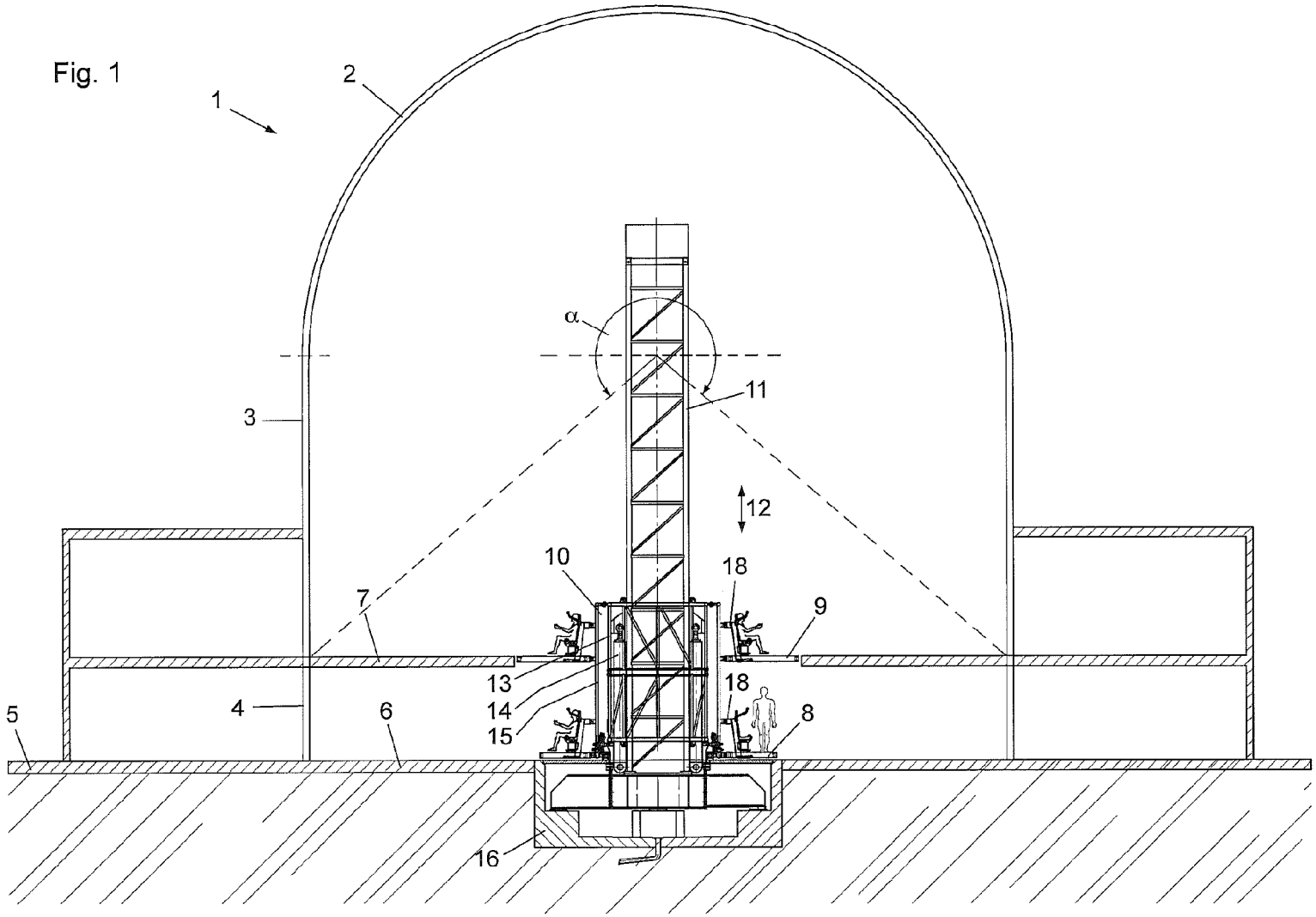
FIG. 1 shows a cross-sectional view of a first embodiment of the invention with an audience platform in a loading position.

In FIG. 1, in a first embodiment of the invention, a projection screen 1 is illustrated which comprises a dome portion 2 and an extension portion 3 in the shape of a cylinder. The dome portion 2 has the shape of a hemispherical dome. The cylindrical extension portion 3 immediately adjoins the dome portion 2 so that a continuous projection screen 1 is achieved. The projection screen 1 is supported on a cylindrical base wall 4, which in turn is supported on a bottom plate 5. If desired, the cylindrical base wall 4 may be used as an additional projection screen.

A portion of the bottom plate 5 that is arranged under the dome 2 serves as a first loading and unloading platform 6. A second loading and unloading platform 7 is arranged on a higher level. The first and the second loading platform 6 and 7 are used by guests to easily access a first audience platform 8 and a second audience platform 9. The first audience platform 8 and the second audience platform 9 are formed substantially in a shape of a ring and are both mounted to a motion base 10.

Figure 3:
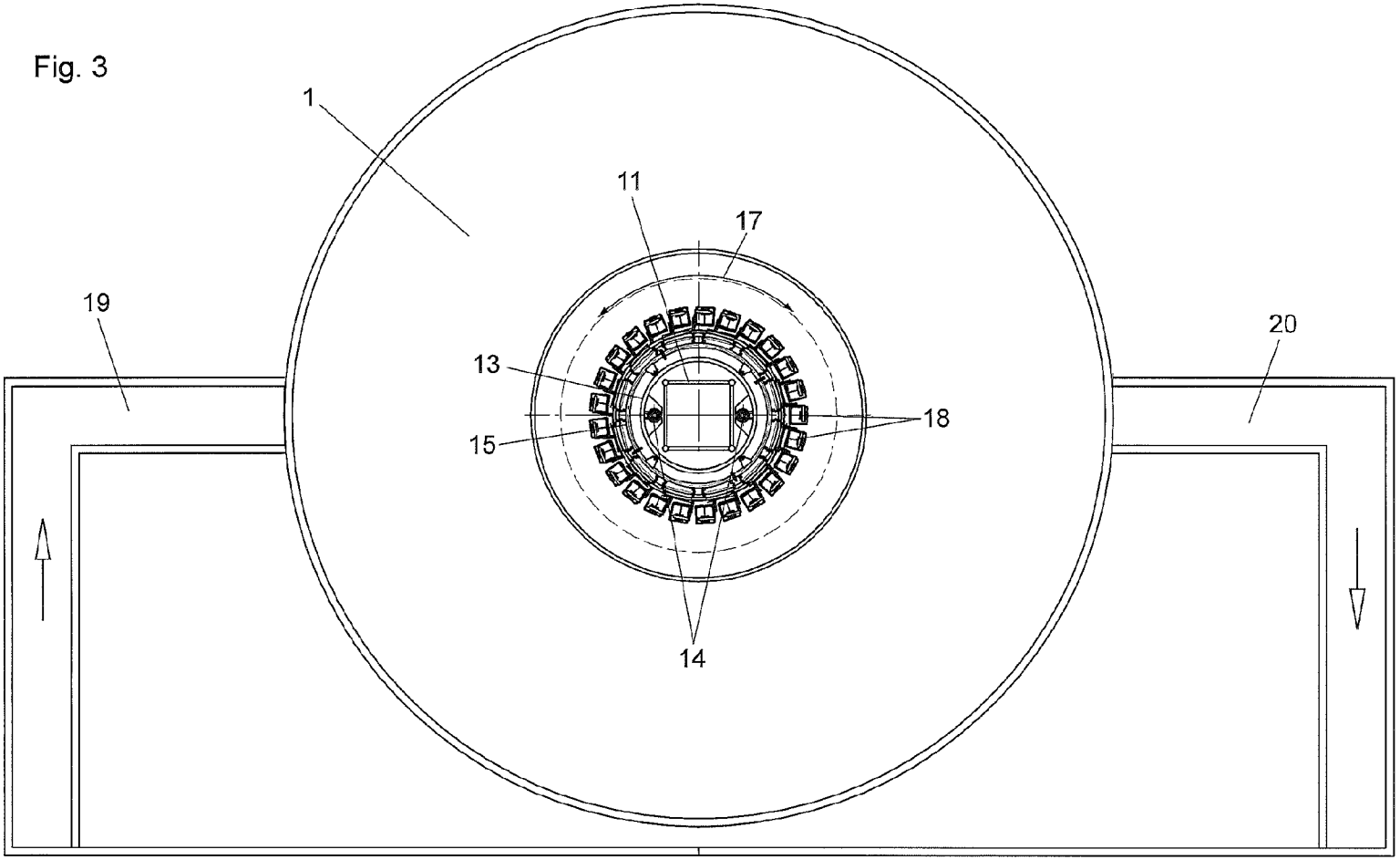
FIG. 3 shows a top view of the first embodiment of the invention.

The motion base 10 is arranged to surround a tower structure 11, which is serving as a shaft to guide the motion base 10 in the height direction (double arrow 12). Specifically, the motion base 10 comprises an inner circular structure 13, which is guided on vertical guiding rails mounted on the tower structure 11 for allowing vertical movement of the motion base 10. The vertical movement is driven by means of hydraulic cylinders 14 supported in a basement 16. Further the motion base 10 comprises an outer circular structure 15 arranged to be coaxial to the inner circular structure 13 and guided to be rotatable relative to the inner circular structure 13 according to arrow 17 (FIG. 3). The first and second audience platforms 8 and 9 are mounted to the outer circular structure 15. A rotational drive for rotating the outer circular structure 15 is also provided (not shown). The rotational drive and the vertical drive (hydraulic cylinders 14) can be operated independently from each other so that any combination of vertical movement and rotational movement can be imparted to the first and second audience platforms 8 and 9.

A plurality of seats 18 is mounted to the first and second audience platforms 8 and 9 in a circular row, as can be seen in the top view according to FIG. 3.

In order to project motion picture on the projection screen 1 a plurality of projectors are arranged to project images onto the outside of the screen 1. The projection system is set up with high resolution projectors in a geometrical alignment which ensures a homogeneous projection of the individual image areas. Each separate image area overlaps with the adjacent areas to allow pixel-exact overlay in the transient areas by using digital image warping and blending to create a seamless overall projection.

An auto-alignment system can be integrated to take care of either initial projection setup as well ongoing adjustments to guarantee a fully automatic calibration of the entire projection. This is realized with a number of network-cameras which observe the full projection area.

The camera-system is also used to capture areas inside the entire projection which need to be digitally black masked e.g. for eventual movable platforms (such as the loading and unloading platform of FIG. 5-8).

In particular, the projectors are arranged to project motion picture on the entire projection screen. The projection screen surrounds the first and second audience platforms 8 and 9 so that the screen extends over an angle of 360° when seen in a horizontal plane (see FIG. 3). Further, the dome portion 2 and the extension portion 3 of the projections screen 1 are arranged and realized such that they together provide a projection surface extending over an angle α of more than 180° measured in a vertical plane from a center of the dome.

Figure 2:
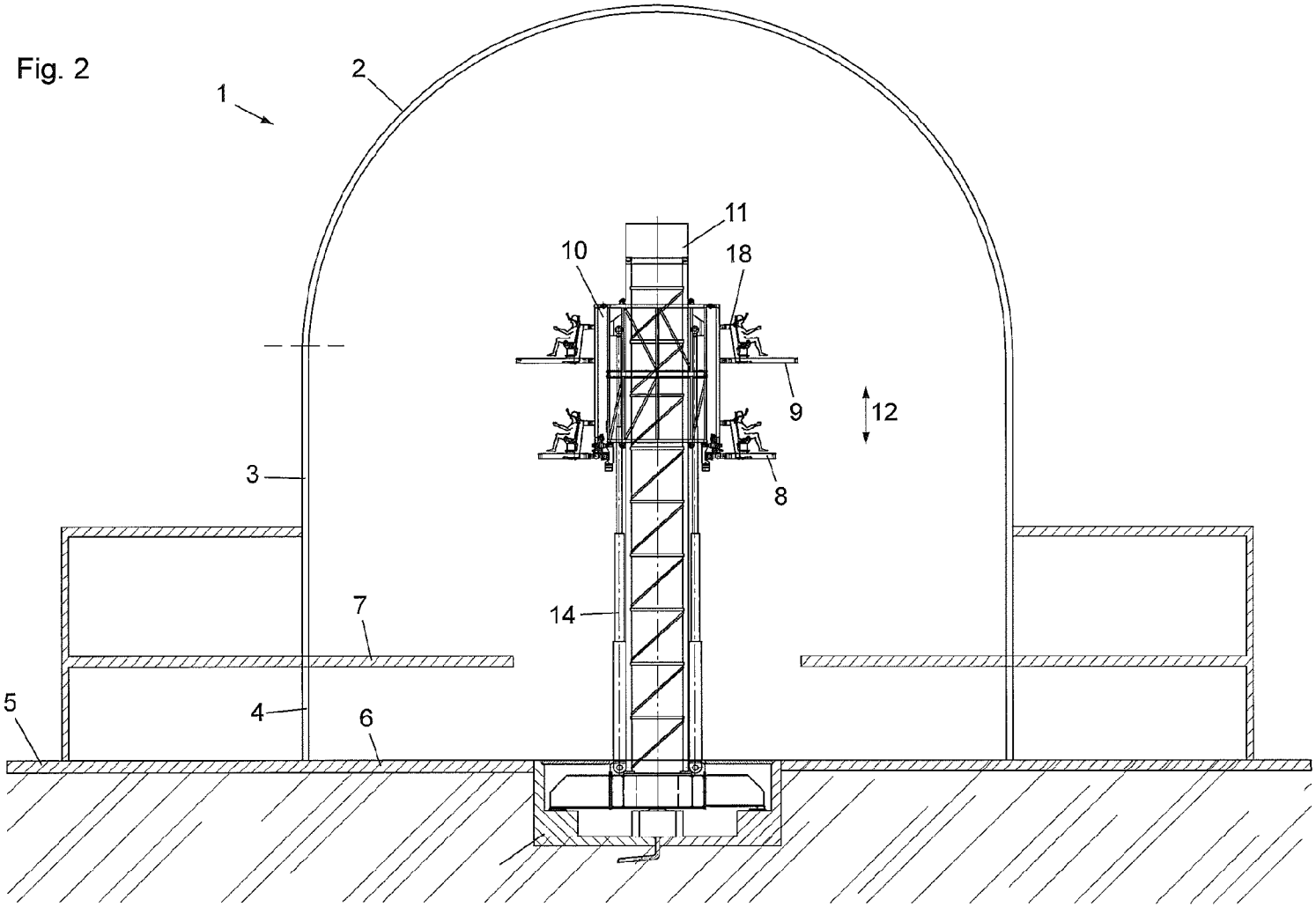
FIG. 2 shows a cross-sectional view of the first embodiment of the invention with the audience platform in an elevated position.

In FIG. 2 the first and second audience platforms 8 and 9 are shown in an elevated position. Accordingly, the hydraulic cylinders 14 are shown in an extended position.

In FIG. 3 the circular row of seats 18 is illustrated. Further, it is shown that the tower structure 11 has a rectangular cross section.

Further, an access path 19 is illustrated, via which guests can access the first and second loading and unloading platforms 6 and 7. After the ride is terminated, the guest can leave the first and second loading and unloading platforms 6 and 7 on the opposite side by way of exit path 20.

Figure 4:
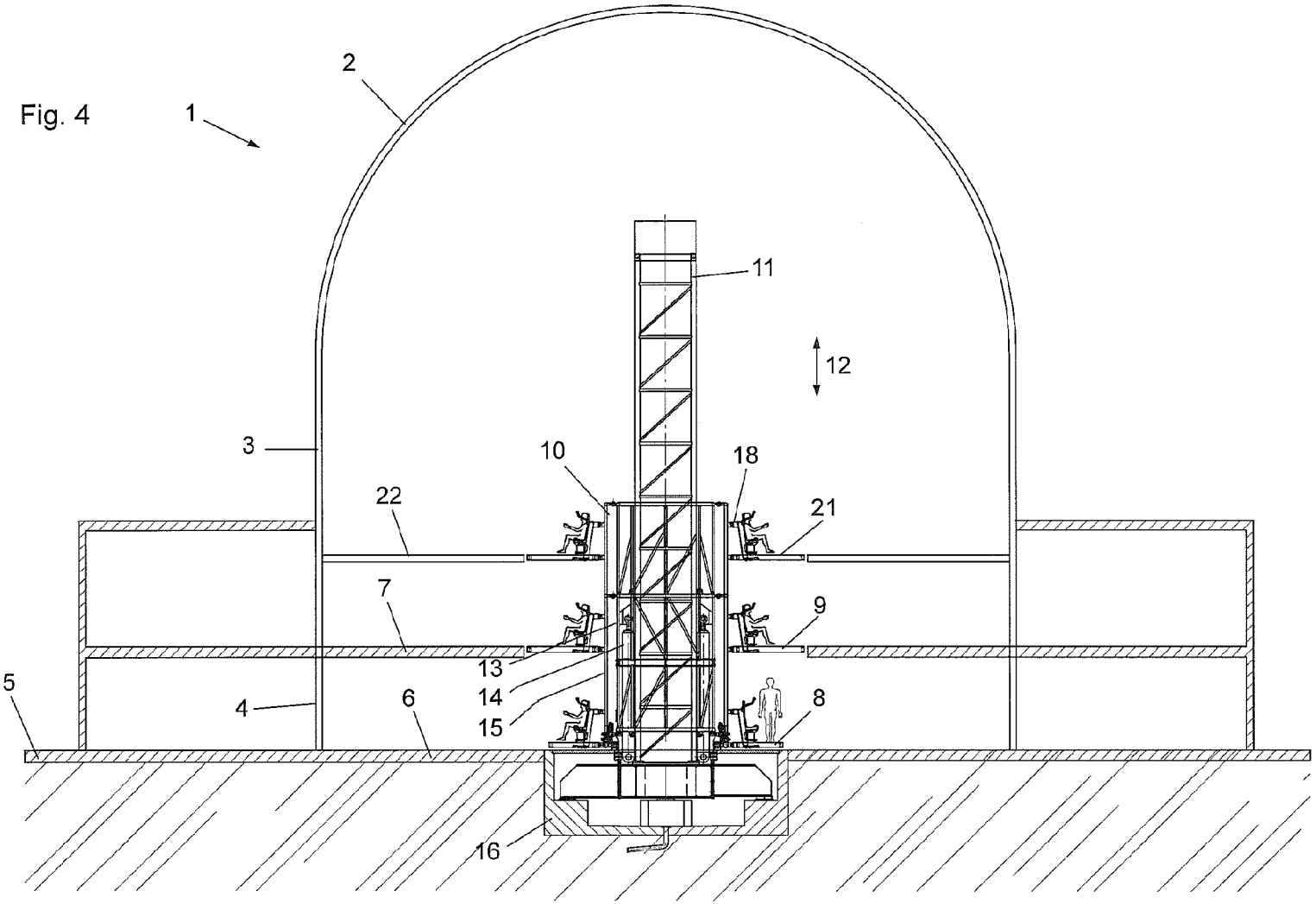
FIG. 4 shows a cross-sectional view of a second embodiment of the invention with an audience platform in a loading position.

FIG. 4 shows an alternative embodiment, which is substantially identical with the embodiment according to FIGS. 1-3, but has a third audience platform 21 and corresponding third loading and unloading platform 22.

Figure 5:
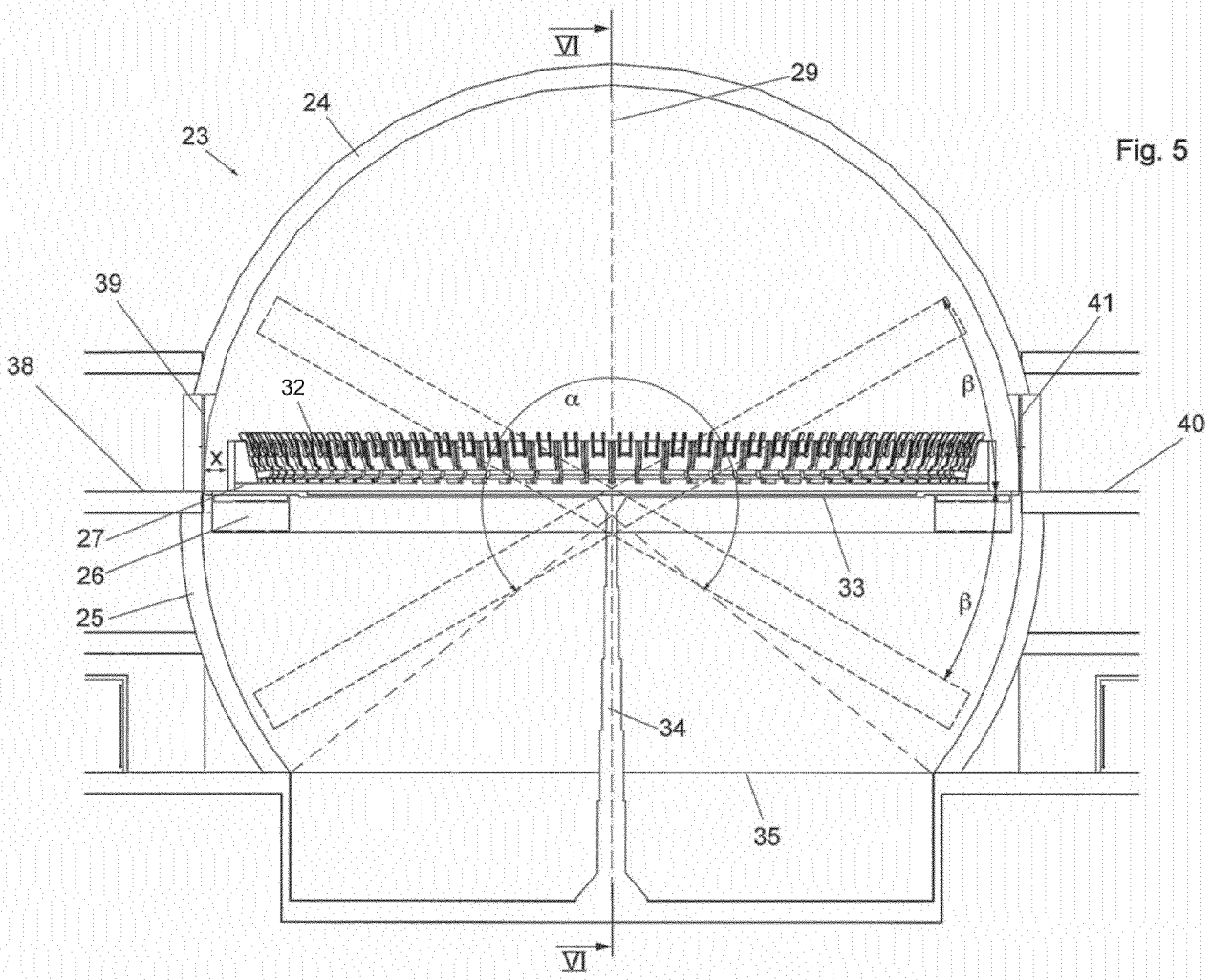
FIG. 5 illustrates a first cross-sectional view of a third embodiment of the invention.

In FIG. 5, in a third embodiment of the invention, a projection screen 23 is illustrated, which comprises a dome portion 24 and an extension portion 25 in the form of a spherical extension of the dome portion 24. The extension portion 25 extends the hemispherical dome of the dome portion 24 to a dome extending over a segment of a sphere having an angle α greater than 180°, in particular at least 210°, measured in a vertical plane from a center of the dome. The extension portion 25 immediately adjoins the dome portion 24 so that a continuous projection screen 23 is achieved.

Figure 6:
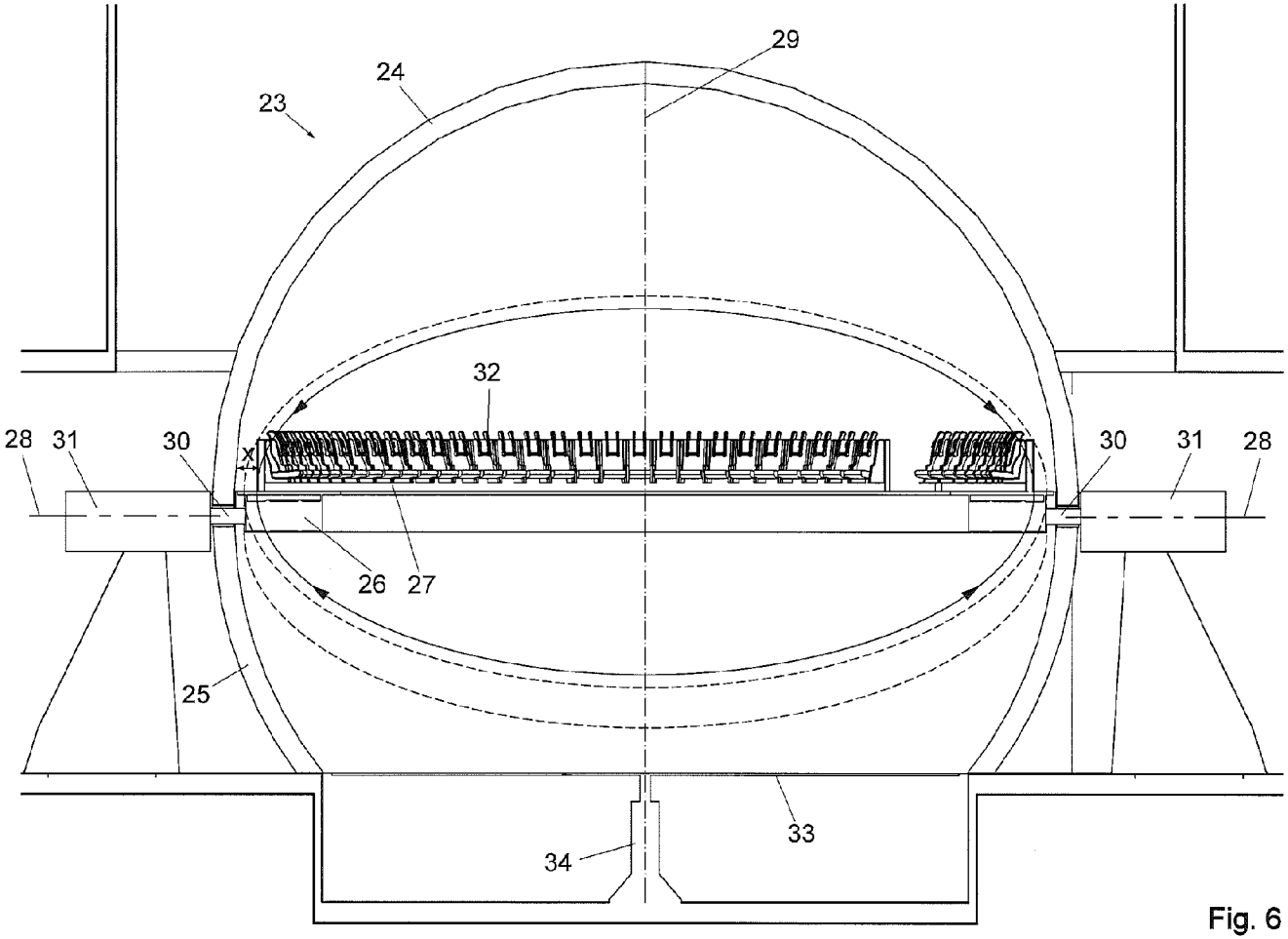
FIG. 6 illustrates a second cross-sectional view of the third embodiment of the invention, and FIG. 7 an alternative embodiment of FIG. 5.

A motion base 26 is arranged in the spherical projection screen 23 and is formed substantially in a shape of a ring. An audience platform 27 is supported on the motion base 26 and is also formed substantially in a shape of a ring. The outer diameter of the audience platform 27 essentially corresponds with the diameter of the spherical projection screen 23. However, there is a small gap x of not more than 2 m between the outer circumference of the audience platform 27 and the projection screen 23 in order to allow a friction free movement of the motion base 26 and the audience platform 27 within the dome. The motion base 26 is supported so as to tilt about a tilting axis 28 extending along a diameter of the spherical projection screen 23 and to rotate about a rotating axis 29 extending transverse to the tilting axis 28. The tilting axis 28 is shown in FIG. 6, which is a cross sectional view along line VI-VI of FIG. 5. Further, FIG. 6 shows two diametrically opposed pivoting shafts 30 that penetrate the projection screen 23 and support the motion base 26.

In FIG. 5 the motion base 26 and the audience platform 27 are shown in a first tilted position and in a second tilted position in dotted lines. In the first tilted position the motion base 26 and the audience platform 27 have been tilted by an angle β30° from the horizontal position. In the second tilted position the motion base 26 and the audience platform 27 have been tilted by an angle β of −30° from the horizontal position.

A tilting drive 31 is provided for tilting the motion base 26 about the tilting axis 28. Further, a rotational drive for rotating the motion base 26 around the rotational axis 29 is also provided (not shown). The rotational drive and the tilting drive 31 can be operated independently from each other so that any combination of rotational movement and tilting movement can be imparted to the audience platform 27. The tilting drive 31 and the rotational drive each comprise an electric or hydraulic motor.

Figure 8:
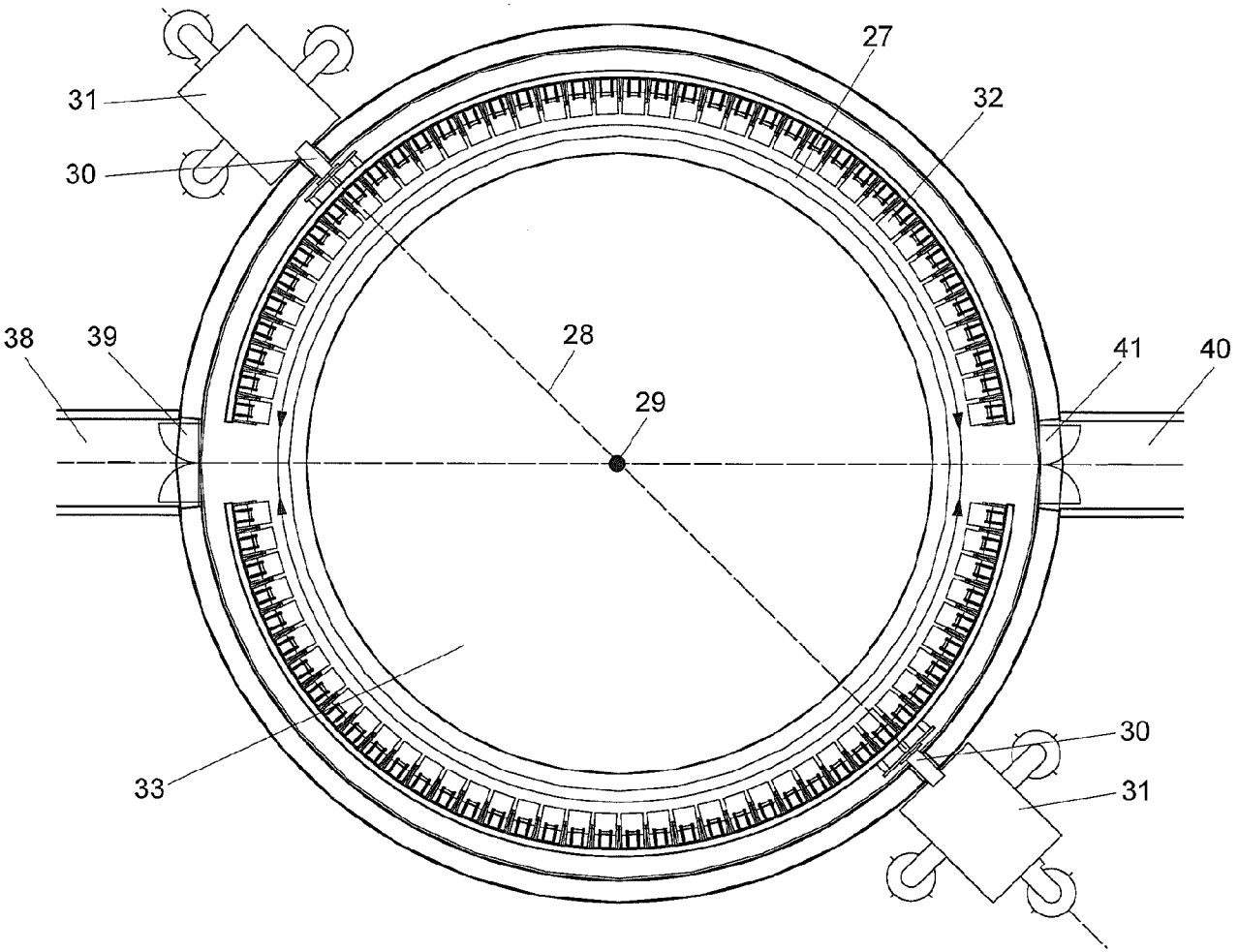
FIG. 8 illustrates a third cross-sectional view of the third embodiment of the invention.

A plurality of seats 32 are mounted to the audience platform 27 in a circular row, as can be seen in the top view according to FIG. 8.

In order to project motion picture on the projection screen 23 a plurality of projectors are arranged. The projectors are arranged such that the image of each projector overlaps the image of an adjacent projector. In this way, a continuous image can be projected on the entire projection screen 23.

In FIG. 5 a loading and unloading platform 33 is shown in an elevated position, i.e. on the same level as the audience platform 27. The loading and unloading platform 33 is used by guests to easily access the audience platform 27. The loading and unloading platform 33 has a circular circumference and has an outer diameter that substantially corresponds to the inner diameter of the audience platform 27. The loading and unloading platform 33 is mounted on a hydraulic cylinder 34 so as to be movable in the vertical direction. During the ride, the loading and unloading platform 34 can be lowered so as to reach the parking position shown in FIG. 6. In this parking position the loading and unloading platform 34 closes the opening 35 of the dome 23. In the parking position the loading and loading platform 34 may be used as an additional projection screen. This allows the user to totally immerse into a virtual world, because he is completely surrounded by moving images.

In particular, the projectors are arranged to project motion picture on the entire projection screen 23. The projection screen 23 surrounds the audience platforms 27 so that the screen extends over an angle of 360° when seen in a horizontal plane (see FIG. 8). Further, the dome portion 24 and the extension portion 25 of the projections screen 23 are arranged and realized such that they together provide a projection surface extending over an angle α of more than 210° measured in a vertical plane from a center of the dome.

Figure 7:
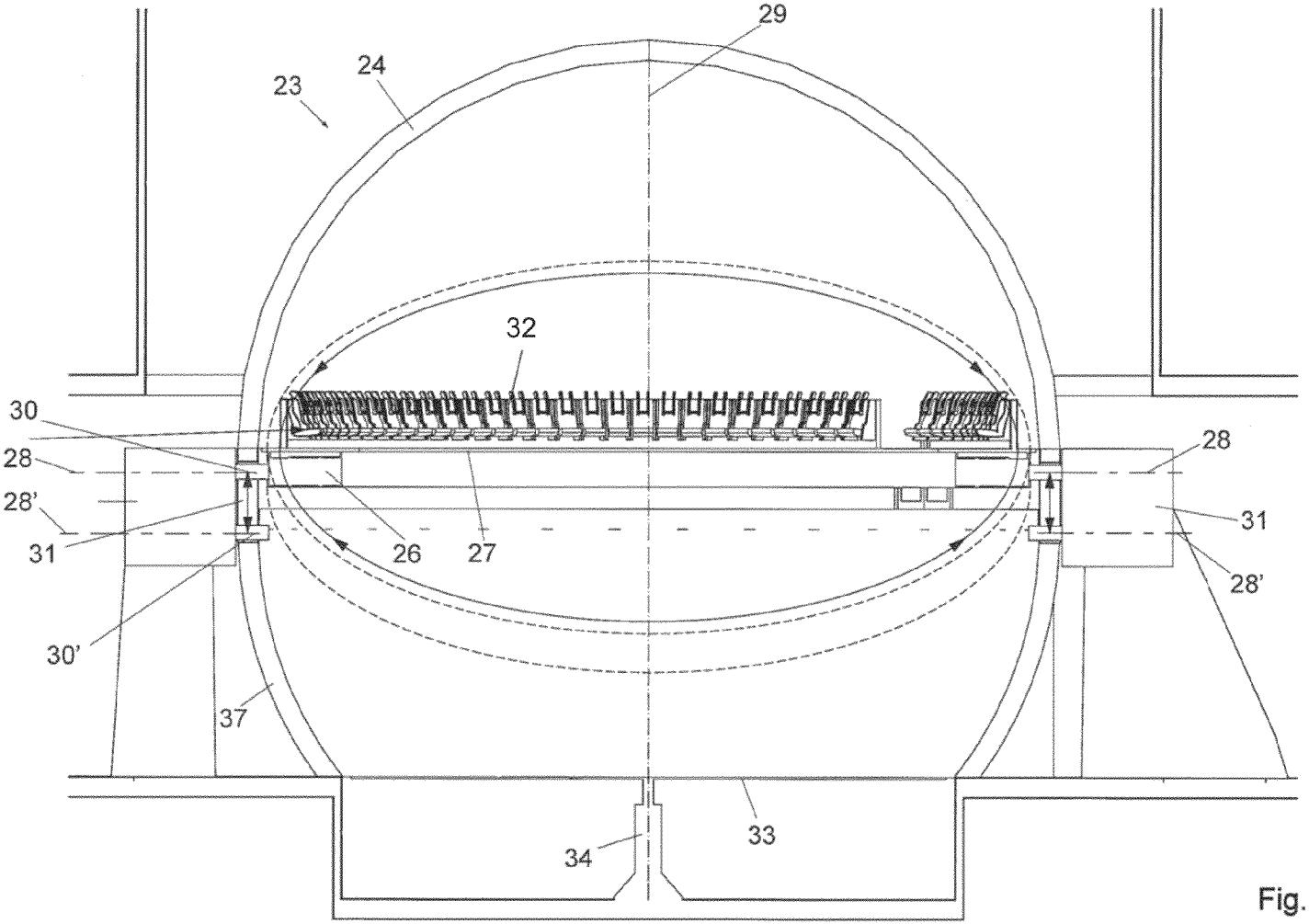

In the alternative embodiment shown in FIG. 7 the motion base 26 is arranged to be movable in the height direction. To this end, the pivoting shaft can be moved between an position 30 and a position 30'. In this configuration, the projection screen has a dome portion 24, a first extension portion and a second extension portion. The first extension portion 36 is in the form of a cylinder, the height of which substantially corresponds to the length of the travel path of the movable pivoting shaft 30. The first extension portion 36 comprises a vertical slit in order to allow a vertical movement of pivoting shaft 30. The second extension portion 37 (corresponding to the extension portion 25 of the embodiment according to FIGS. 5 and 6) is a spherical extension of the dome portion 24.

In the top view according to FIG. 8 an access path 38 and an access door 39 are illustrated, via which guests can access the audience platform 27 and the loading and unloading platform 33. After the ride is terminated, the guest can leave the audience platform 27 and the loading and unloading platform 33 on the opposite side by way of exit door 41 and exit path 40. The access path 38 and the exit path 40 are situated on the same level as the audience platform 27 and the loading and unloading platform 33 when in its loading and unloading position.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. An amusement ride comprising:

a motion base, an audience platform mounted to the motion base, wherein the motion base is guided on a vertical shaft so as to be displaceable in the height direction, a plurality of seats, each accommodating at least one guest, supported on the audience platform, wherein the seats are arranged in at least one circular row and wherein the audience platform is in the form of a ring surrounding the vertical shaft and is arranged to be rotated about a vertical axis of the shaft, a 360° projection screen surrounding the audience platform, wherein the projection screen comprises a dome portion and a lower extension portion directly adjoining the dome portion, wherein the lower extension portion is formed substantially in a shape of a cylinder, a plurality of projectors being arranged to project images on the entire projection screen.

2. The amusement ride according to claim 1, wherein the motion base is configured to tilt, rotate, raise and/or lower the audience platform.

3. The amusement ride according to claim 1, wherein the dome portion of the projection screen is formed substantially in a shape of a hemispherical dome.

4. The amusement ride according to claim 1, wherein at least one stationary loading and unloading platform is arranged within the cylindrical extension portion of the projection screen, said loading and unloading platform having a central opening with a diameter substantially corresponding to an outer diameter of the ring-shaped audience platform.

5. The amusement ride according to claim 4, wherein the loading and unloading platform has a circular outer circumference, wherein the loading and unloading platform has an outer diameter substantially corresponding to an inner diameter of the cylindrical extension portion of the projection screen.

6. The amusement ride according to claim 1, wherein the seats in the circular row are arranged such that the guests, when seated, are oriented radially outwardly or radially inwardly.

7. An amusement ride comprising:

a motion base, an audience platform mounted to the motion base, a plurality of seats, each accommodating at least one guest, supported on the audience platform, wherein the seats are arranged in at least one circular row, a 360° projection screen surrounding the audience platform, wherein the projection screen comprises a dome portion and a lower extension portion directly adjoining the dome portion, wherein the lower extension portion is in the form of a spherical extension of the dome portion, a plurality of projectors being arranged to project images on the entire projection screen.

8. The amusement ride according to claim 7, wherein the audience platform has a circular outer circumference, the curvature of which substantially corresponds to the curvature of the spherical dome portion and the spherical extension portion of the projection screen.

9. The amusement ride according to claim 8, wherein the motion base is formed substantially in a shape of a ring, said ring being supported so as to tilt about a tilting axis extending along a diameter of the dome portion of the projection screen and to rotate about a rotating axis extending transverse to the tilting axis.

10. The amusement ride according to claim 9, wherein the audience platform is in the form of a ring.

11. The amusement ride according to claim 10, wherein at least one circular loading and unloading platform is arranged within the projection screen, an outer diameter of said loading and unloading platform substantially corresponding to an inner diameter of the ring-shaped audience platform.

12. The amusement ride according to claim 11, wherein an outer diameter of said circular loading and unloading platform substantially corresponds to an inner diameter of a lower opening of the spherical extension portion.

13. The amusement ride according to claim 11, wherein the circular loading and unloading platform is arranged to be raised to a level of the audience platform and lowered to a parking position.

14. The amusement ride according to claim 11, wherein the seats in the circular row are arranged such that the guests, when seated, are oriented radially outwardly or radially inwardly.

15. The amusement ride according to claim 7, wherein the motion base is configured to tilt, rotate, raise and/or lower the audience platform.

16. The amusement ride according to claim 7, wherein the dome portion of the projection screen is formed substantially in a shape of a hemispherical dome.

* * * * *